United States Patent [19]

Cherry

[11] Patent Number: 4,464,073

[45] Date of Patent: Aug. 7, 1984

[54] CONNECTORS FOR GEODESIC DOME STRUCTURES

[76] Inventor: Arthur R. Cherry, 4050 Wetumpka Hwy., Montgomery, Ala. 36110

[21] Appl. No.: 439,286

[22] Filed: Nov. 4, 1982

[51] Int. Cl.[3] ..... E04B 1/32

[52] U.S. Cl. ..... 403/170; 403/174; 403/217; 403/219; 52/81; 16/365

[58] Field of Search ..... 403/174, 178, 170, 217, 403/219, 364, 171; 52/80, 648, 81, 82; 24/219, 220, 257; 135/106, 107, 108, DIG. 9; 16/365, 370, 387

[56] References Cited

U.S. PATENT DOCUMENTS

| | | | |
|---|---|---|---|
| 32,585 | 6/1861 | Pullan | 403/174 X |
| 1,010,949 | 12/1911 | Polverino | 16/365 |
| 1,084,480 | 1/1914 | Polverino | 16/365 |
| 1,375,212 | 4/1921 | Crone | 16/231 |
| 2,108,774 | 2/1938 | Lipert | 403/170 |
| 3,178,780 | 4/1965 | Booher | 403/260 |
| 3,186,522 | 6/1965 | McCauley | 52/378 |
| 3,301,473 | 1/1967 | Weninger | 403/219 X |
| 3,486,278 | 12/1969 | Woods | 403/172 X |
| 3,521,421 | 7/1970 | Schroeder | 52/648 |
| 3,635,509 | 1/1972 | Birkemeier et al. | 52/665 X |
| 3,844,074 | 10/1974 | Ahern | 52/582 X |
| 3,990,195 | 11/1976 | Gunther | 403/175 X |
| 4,070,846 | 1/1978 | Sohlberg | 403/172 X |
| 4,262,461 | 4/1981 | Johnson et al. | 403/172 X |

*Primary Examiner*—Cornelius J. Husar
*Assistant Examiner*—Joseph A. Fischetti
*Attorney, Agent, or Firm*—Peter L. Klempay

[57] ABSTRACT

Connectors for joining struts used to form geodesic domes have first and second sets of semicylindrical portions located alternately on opposite sides of the longitudinal centerline of the connector. In the assembled joint, the first and second sets of adjacent connectors are interleaved and secured by pins or bolts forming hinge-like interconnections.

5 Claims, 13 Drawing Figures

FIG. 1
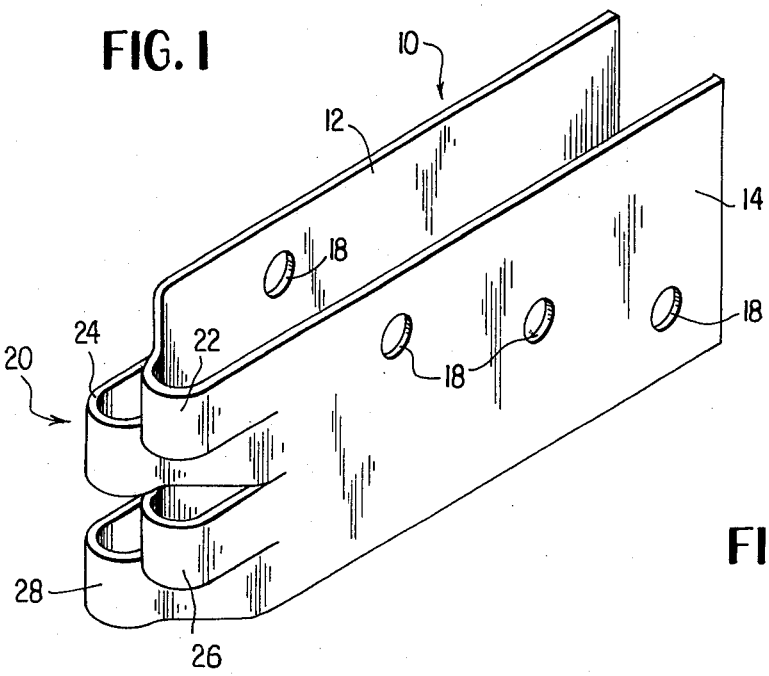
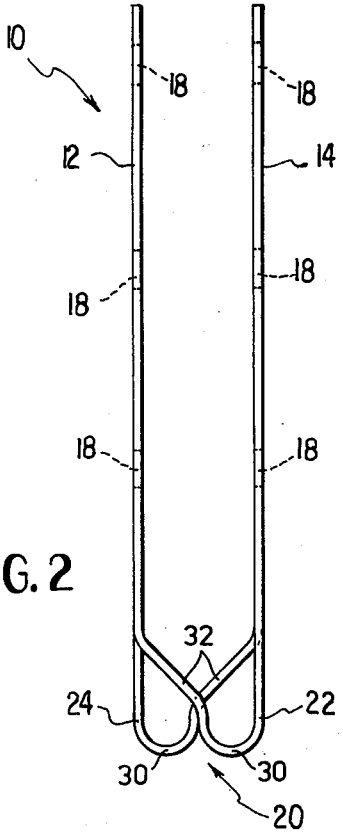
FIG. 2
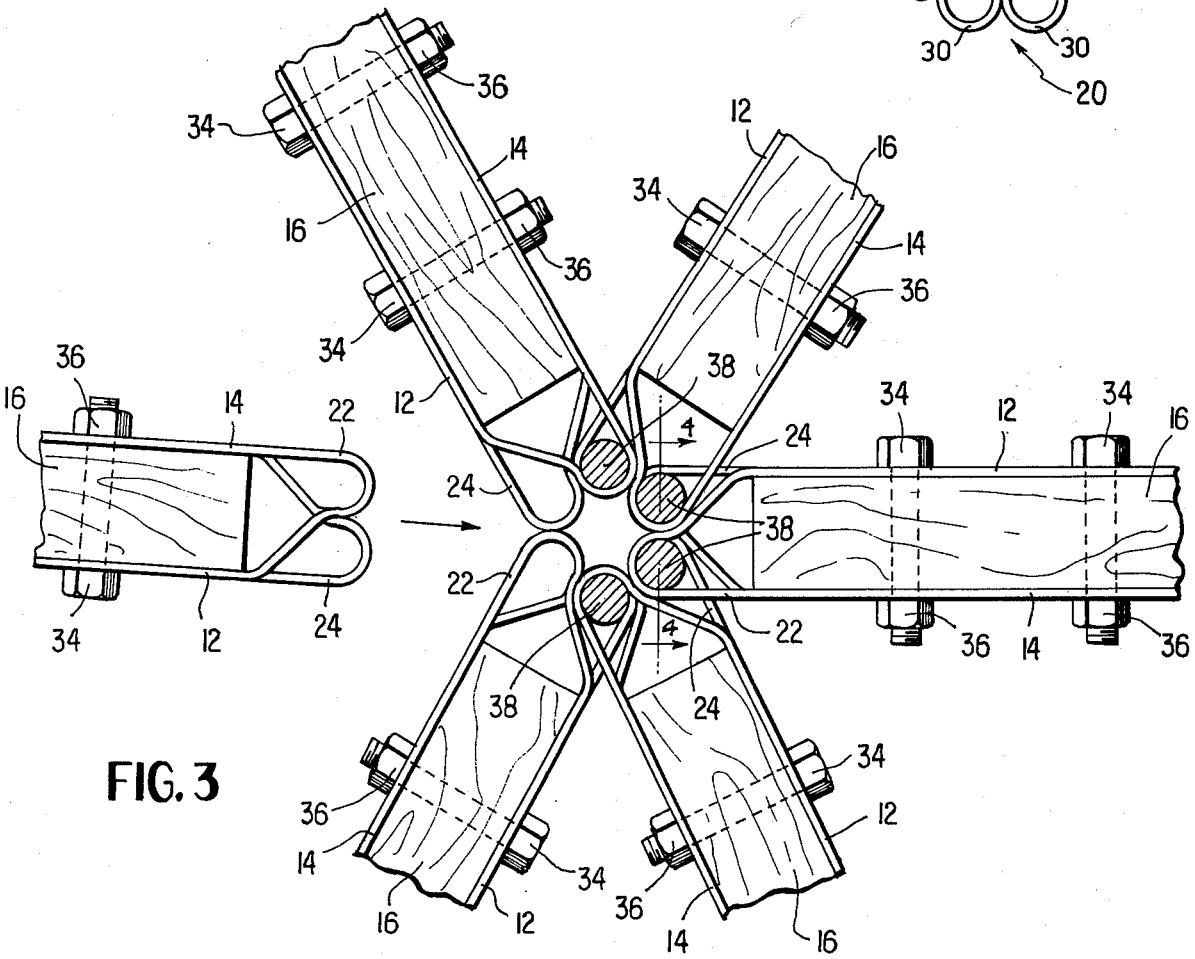
FIG. 3

FIG. 7
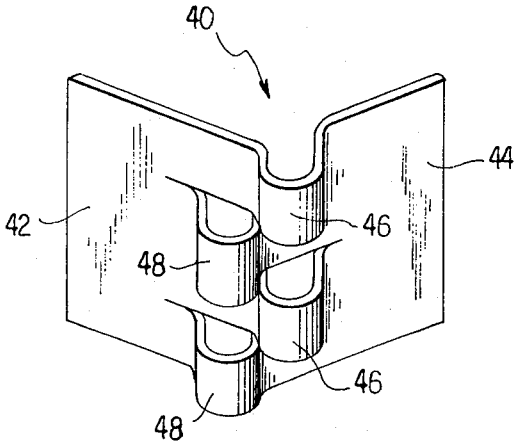
FIG. 8
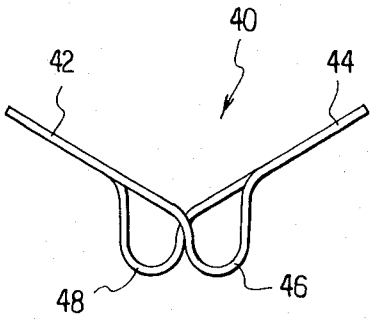
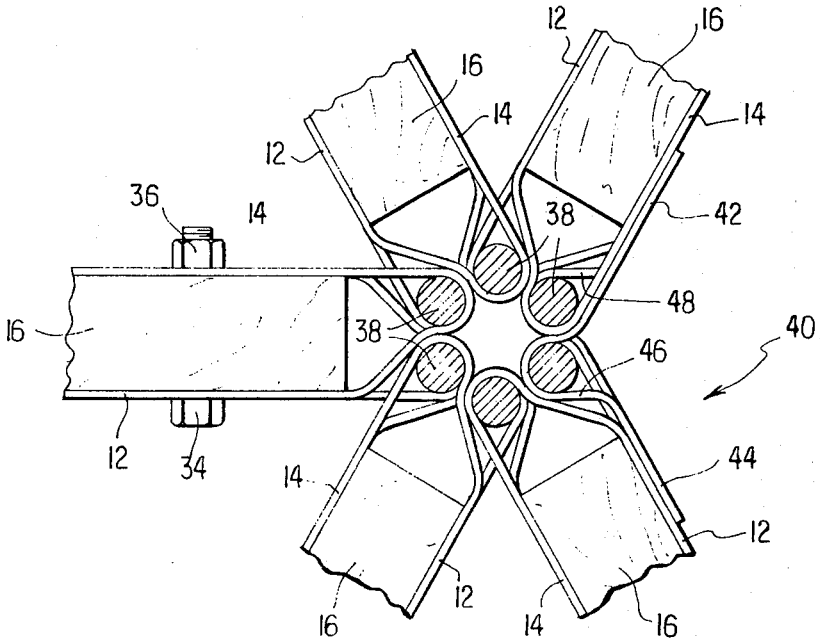
FIG. 9

FIG. 10
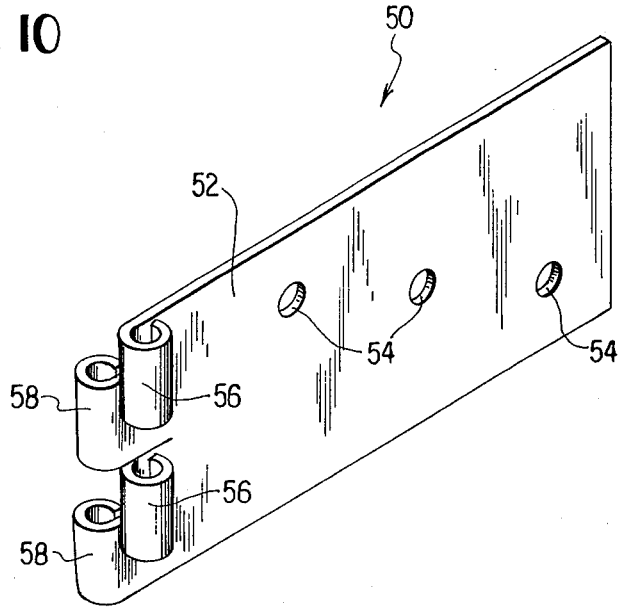
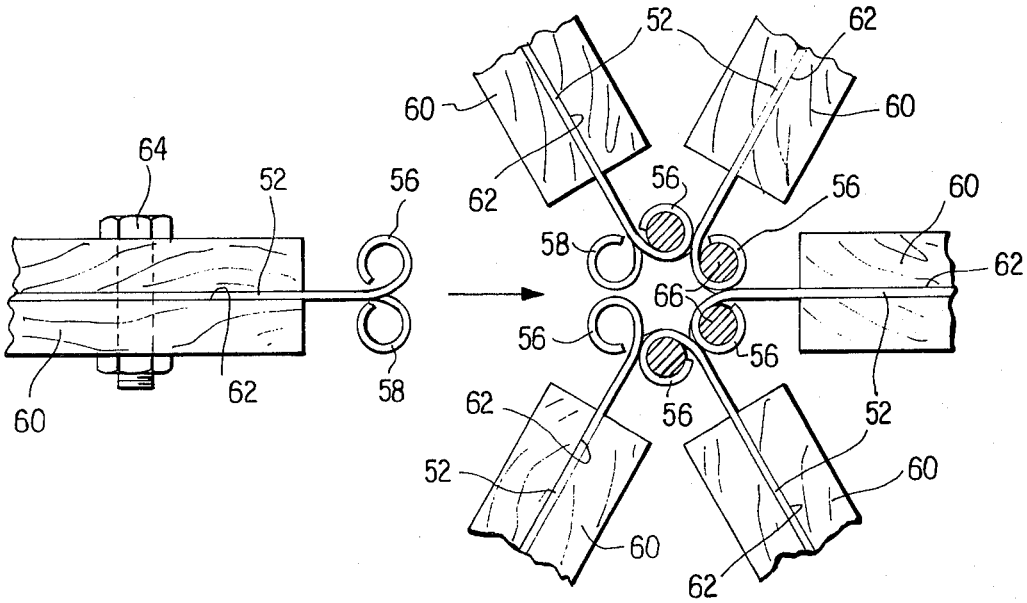
FIG. 11

FIG. 12
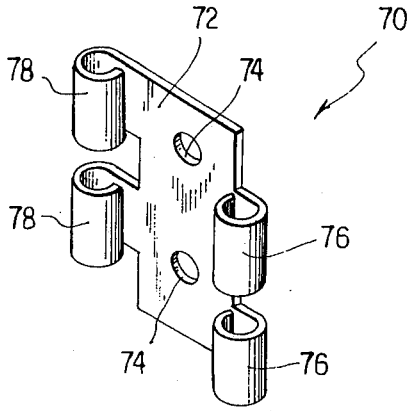
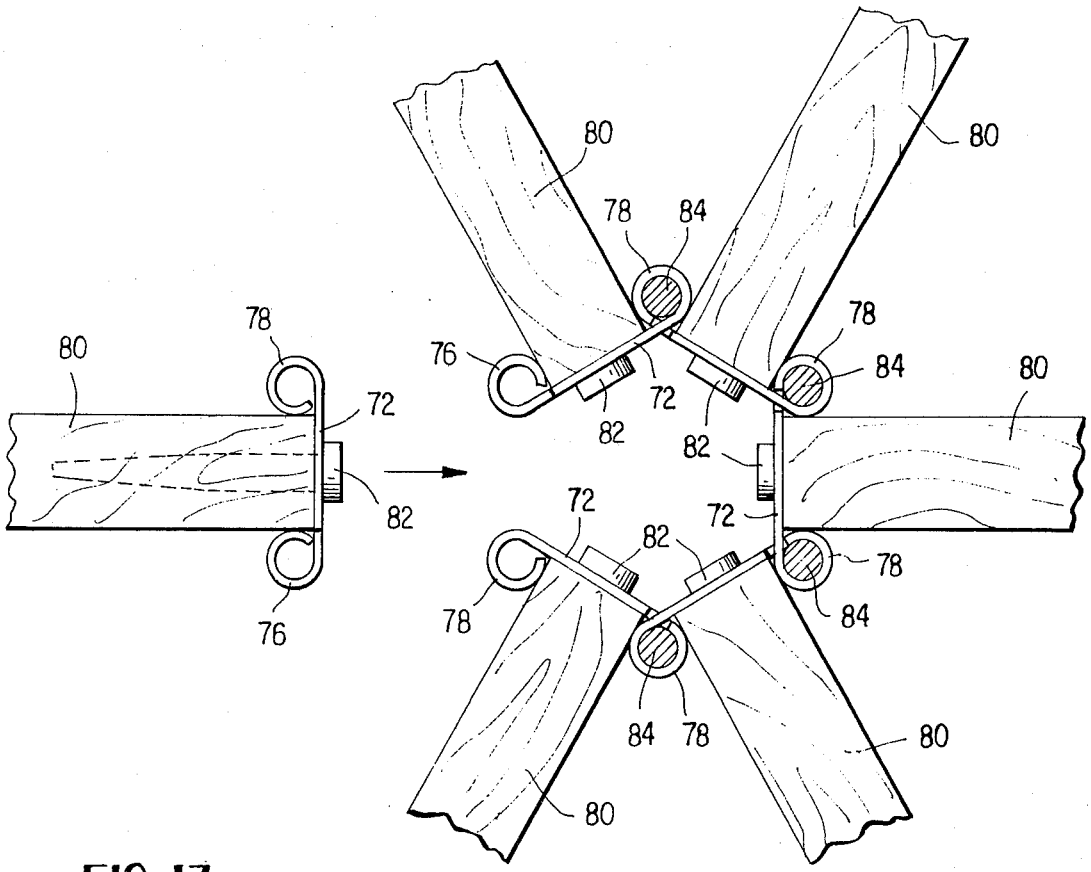
FIG. 13

CONNECTORS FOR GEODESIC DOME STRUCTURES

The present invention pertains to the construction of geodesic domes and, more particularly, to connectors for joining the framing members of such domes.

BACKGROUND OF THE INVENTION

Geodesic domes are generally constructed either of preformed triangular panels which are bolted together to form the dome or of individual structural members which are joined together during construction of the dome to form a space frame which is subsequently covered. In the space frame construction method it is necessary to connect as many as six structural members at a common point. Mitering of the individual members so that the members interfit at the common point is a costly process, requiring precise woodworking and skilled assembly. In order to simplify dome construction, a number of connectors have been proposed in the prior art. Among these are the connectors shown in U.S. Pat. Nos. 3,186,522, McCauley; 3,486,278, Woods; 3,635,509, Birkemeier et al; 3,810,342, Scott; 3,844,074, Ahern; 3,990,195, Gunther; and 4,262,461, Johnson et al. Many of these prior art connectors require the use of a central hub member which is of relatively complex and, accordingly, expensive construction. Others of the prior art connectors are suitable only for use where the angular relationships of the structural members are precisely uniform, a condition that frequently is not present in actual construction situations.

It is the primary object of the present invention to provide an improved connector for use in space frame geodesic dome construction which is characterized by its simplicity, permitting inexpensive construction and facilitating the dome assembly.

It is a further object of the invention to provide a connector for use in space frame geodesic dome construction which is readily adaptable to accomodate variations occuring during dome construction.

SUMMARY OF THE INVENTION

The above and other objects of the invention which will become apparent hereinafter are achieved by the provision of a connector element for geodesic dome structural members which element has a portion adapted to be secured to the structural member and, extending from the end of the member, first and second sets of semicylindrical portions located alternately on opposite sides of the longitudinal centerline of the member. When adjacent structural members are assembled to form a joint, the first set of semicylindrical portions of the connector element attached to one structural member are interleaved with the second set of semicylindrical portions of the connector element attached to the adjacent structural member. Each such hinge-like interconnection is secured by a bolt or pin passing through the semicylindrical portions.

For a more complete understanding of the objects and advantages of the present invention reference should be had to the following detailed description and the accompanying drawings wherein preferred embodiments of the invention are described and shown.

BRIEF DESCRIPTION OF THE DRAWINGS

In the drawings:

FIG. 1 is a perspective elevational view of a first embodiment of the connector element of the present invention;

FIG. 2 is a plan view of the connector element of FIG. 1;

FIG. 3 is a plan view of a partially assembled connection employing the connector elements of FIG. 1;

FIG. 7 is a perspective elevational view of a second embodiment of the connector element of the present invention;

FIG. 8 is a plan view of the connector element of FIG. 7;

FIG. 9 is a plan view of a geodesic dome joint utilizing the element of FIGS. 7 and 8;

FIG. 10 is a perspective elevational view of a modified form of the connector of the present invention;

FIG. 11 is a plan view of a connection formed with the connector elements of FIG. 10;

FIG. 12 is a perspective elevational view of another modified form of the connector element of the present invention; and FIG. 13 is a plan view of a connection formed with the connector elements of FIG. 12.

DETAILED DESCRIPTION OF THE PREFERRED EMBODIMENTS

Figure 4:
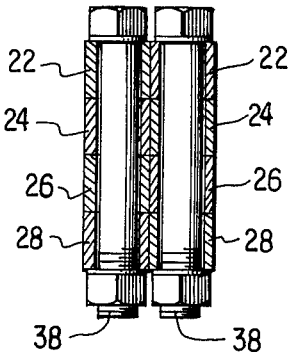
FIG. 4 is a transverse sectional view taken on the line 4—4 of FIG. 3.

Referring first to FIGS. 1–3, the connector element designated generally by the reference numeral 10 is of single piece construction, preferrably being formed from a steel strip. The connector element has parallel side portions 12, 14 spaced apart by a distance equal to the thickness of the structural member 16 to which the connector element is attached. Aligned holes 18 in the portions 12, 14 are provided for bolting the element 10 to the structural member 16. The intermediate portion 20 of the element 10 which connects the side portions 12, 14 is provided with three parallel slots dividing this portion into four sections 22, 24, 26, 28. Each section includes a semicylindrical portion 30 extending tangentialy from one of the side portions 12 or 14 and a diagonal portion 32 extending to the other of the side portions. The sections are formed so that alternate semicylindrical portions are on opposite sides of the longitudinal centerline of the connector element and, as can be seen from FIG. 2, the outer faces of the semicylindrical portions are tangent to this centerline.

As was discussed above, a typical geodesic dome joint comprises six structural members extending at generally uniform angular spacing from a common point. The assembling of such a joint with the connector elements 10 is shown in FIGS. 3 and 4. Each structural member 16, which may be a wooden strut, has a connector element 10 attached to the end thereof and secured by any suitable means such as bolts 34 and nuts 36. Adjacent ones of the connector elements are positioned so that the semicylindrical portions of the connector elements are interleaved, forming a hinge-like knuckle joint. A pin or bolt 38 secures each joint. When the six structural members are so interconnected, the resultant ring-like configurations formed of the interlocking semicylindrical portions of the connector elements provides a structural joint transferring the loads between the structural members.

It will be apparent that only a minimum of preparation of the structural members is required as no mitering or other precision fitting of the members is necessary. The hinge-like interconnections of the connector elements allows the joint to compensate for variations in the angular relationships of adjacent structural members, the joint being capable of accomodating an angular variation of 10°–12° between adjacent members.

Figure 5:
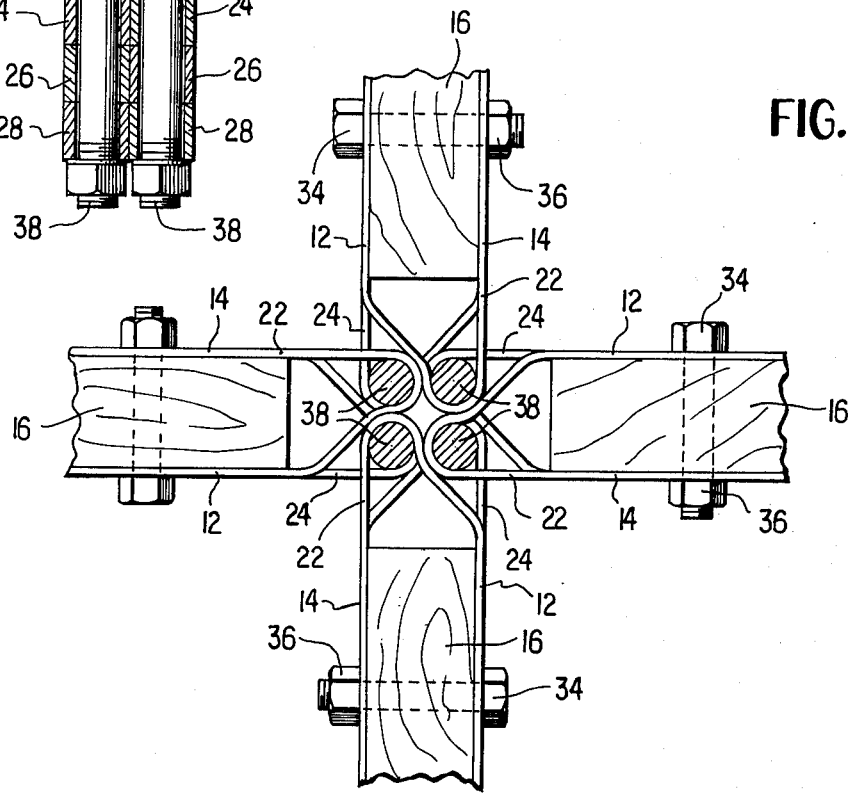
FIGS. 5 and 6 are plan views of connections formed with four and five framing members, respectively.
Figure 6:
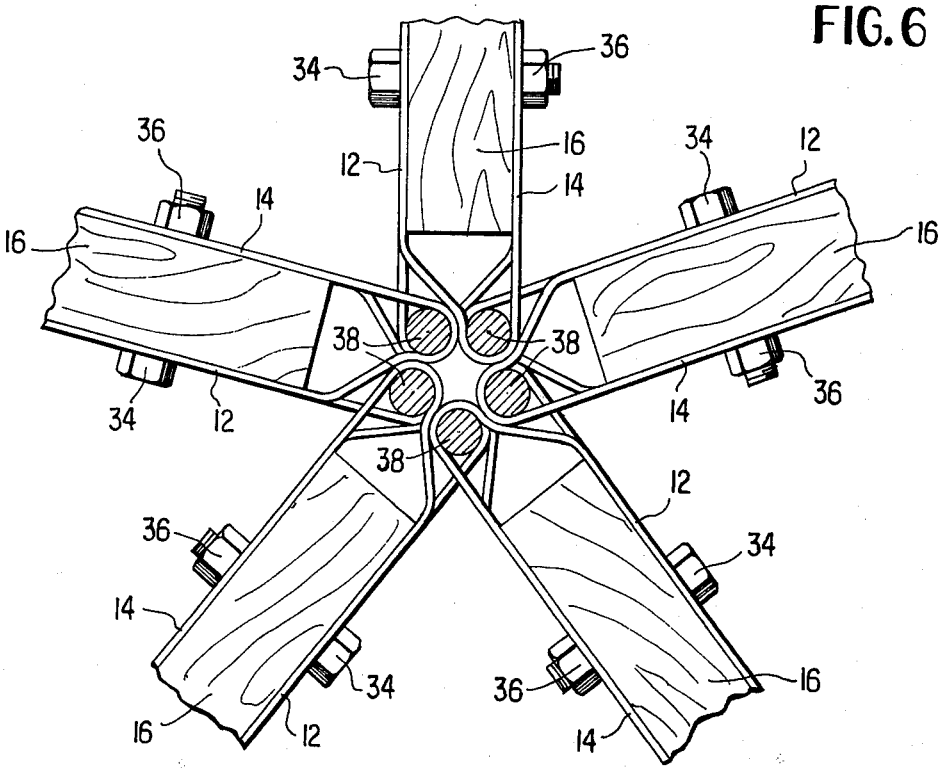

While the joint assembly of FIG. 3 connects six framing or structural members, the most commonly encountered joint in geodesic dome construction, the connector elements of the present invention are equally usable in assembling joints involving a greater or lesser number of framing members. Four and five member joints are shown in FIGS. 5 and 6, respectively.

In the construction of geodesic domes, it is sometimes necessary to remove or omit a structural member, for example, to provide an opening for the installation of a door or window. A bridging connector element 40 for use in such situations is shown in FIGS. 7 and 8. The element has a pair of flat plate or wing portions 42, 44 angled relative to one another by an angle equal to approximately twice the angle between adjacent structural members of the joint.

Thus, when the bridging element is to be used in place of one structural member in a six member joint, the angle between the wing portions is approximately 120° and, preferrably, 124°. At the intersection of the wing portions, the bridging connector is formed with first and second pairs of semicylindrical portions 46, 48 arranged in the same manner as the semicylindrical portions of the connector elements 10.

As will be seen from FIG. 9, the bridging connector element 40 serves to complete the circle of interleaved semicylindrical portions. The wing portions of the element 40 bear against the sides of the portions 12, 14 of the connectors 10 attached to the structural members on opposite sides of the opening formed by omitting a structural member.

A modified connector element 50 is shown in FIGS. 10 and 11. This connector element has an elongated plate-like portion 52 provided with bolt holes 54 and, at one end, first and second pairs of knuckles 56, 58. This connector element is secured to the framing member 60 by inserting the same into a slot 62 extending inwardly from the end of the member on the longitudinal centerline thereof and is secured by bolts 64. As with the previously described embodiment, the joint is formed by interengaging the knuckles 56, 58 of adjacent connector elements and securing the same with bolts or pins 66.

A further modification of the connector element is illustrated in FIGS. 12 and 13 and comprises a plate portion 72 having bolt holes 74 and provides on opposite edges thereof with first and second pairs of knuckles 76, 78. This connector element is designed to be attached to the end of a framing member 80 and secured thereto by lag bolts 82.

While preferred embodiments of the invention have been illustrated and described, it will be understood that changes and additions may be made therein. Accordingly, reference should be had to the appended claims in determining the scope of the invention.

I claim:

1. A connector assembly for connecting a plurality of framing struts of a space frame geodesic dome in which said struts radiate from a common point comprising:

a connector element for each said strut, each element having a mounting portion adapted to be secured to the corresponding strut and, adjacent the end of said strut, first and second sets of semicylindrical portions located, respectively, on opposite sides of and externally tangent to the longitudinal centerline of said strut, the semicylindrical portions of said first set alternating with those of said second set whereby, in an assembled connection, the first set of each element is interleaved with the second set of the adjacent element forming a hinge-like knuckle joint;

means for affixing each said connector element to said corresponding strut; and pin means adapted to extend through said interleaved first and second sets of semicylindrical portions.

2. The connector assembly of claim 1 wherein each connector element is of single piece construction, said mounting portion comprises a pair of parallel side portions adapted to engage opposite sides of said strut and said sets of semicylindrical portions join said side portions to one another.

3. The connector assembly of claim 2 wherein said semicylindrical portions of each set are externally tangent to the corresponding side portions.

4. The connector assembly of claim 1 wherein each connector element is of single piece construction, said mounting portion comprises a flat plate portion adapted to be received in a slot in said strut and said sets of semicylindrical portions are formed at one end of said flat plate portion.

5. The connector assembly of claim 1 further including a bridging connector element adapted for use in a connector assembly in which a framing strut is omitted, said bridging connector element having a pair of wing portions adapted to abut against the sides of the framing struts on opposite sides of the location from which the strut is omitted and, connecting said wing portions, first and second sets of semicylindrical portions adapted to interleave with the sets of semicylindrical portions of the connector elements of said framing struts on opposite sides thereof.

* * * * *